US005467937A

United States Patent [19]

Rodriquez et al.

[11] Patent Number: 5,467,937

[45] Date of Patent: Nov. 21, 1995

[54] TRACK ASSEMBLY FOR A CUTTING TAPE

[75] Inventors: Peter A. Rodriquez, Atlantic Beach; Craig R. Austin, Jacksonville, both of Fla.

[73] Assignee: Sandar Industries, Inc., Jacksonville, Fla.

[21] Appl. No.: 152,750

[22] Filed: Nov. 15, 1993

[51] Int. Cl.[6] ..... B65M 19/28

[52] U.S. Cl. ..... 242/526.2; 226/196

[58] Field of Search ..... 242/56 R, 65, 242/74, 76, 526.2; 226/196

[56] References Cited

U.S. PATENT DOCUMENTS

| | | | |
|---|---|---|---|
| 2,461,246 | 2/1949 | Weyenberg | 242/56 R |
| 3,131,843 | 5/1964 | Bentley | 242/76 |
| 3,421,675 | 1/1969 | Braun et al. | 226/196 |
| 3,588,346 | 6/1971 | Ramig | 242/76 X |
| 3,599,888 | 8/1971 | Coudriet et al. | 242/64 |
| 3,746,234 | 7/1973 | Mischo et al. | 226/196 |
| 3,765,615 | 10/1973 | Brink et al. | 242/56 R |
| 3,854,642 | 12/1974 | Mueller | 226/196 X |
| 4,265,176 | 5/1981 | Sato | 226/196 X |
| 4,335,858 | 6/1982 | Cranva | 242/76 X |
| 4,659,029 | 4/1987 | Rodriquez | 242/56 R |
| 4,711,404 | 12/1987 | Falk | 242/56 R |
| 4,783,018 | 11/1988 | Rodriquez | 242/56 R |
| 4,964,584 | 10/1990 | Taipole et al. | 242/56 R |
| 5,046,675 | 9/1991 | Rodriquez | 242/56 R |

*Primary Examiner*—Daniel P. Stodola
*Assistant Examiner*—John P. Darling
*Attorney, Agent, or Firm*—Arthur G. Yeager

[57] ABSTRACT

An assembly is provided to support a track for guiding a cutting tape across the width of a travelling web of paper being wound up on a roll, which must eventually be cut and transferred to an empty wind up roll. The assembly includes a track to guide the cutting tape, a track carrier to hold the track, and a track carrier support to be fastened to the track carrier and support it above a flat base.

23 Claims, 3 Drawing Sheets

TRACK ASSEMBLY FOR A CUTTING TAPE

BACKGROUND OF THE INVENTION

In the paper industry a wide web of paper is produced and wound onto rolls at a high rate of speed (500–4000 feet per minute). Intermittently, it is necessary to transfer the web to a new roll without interrupting the travel of the web. This has been done by using a "turn-up" tape such as that described in U.S. Pat. Nos. 2,461,246; 3,599,888; 3,765,615; 4,659,029; and 4,783,018. In my U.S. Pat. No. 4,659,029 there is a disclosure of a cutting tape made of a plurality of parallel strands of repulpable paper, and this tape has been found to be very useful in the above process for cutting the web and transferring the web to a new roll. Among the operations involved in the cutting and transferring is the use of a track to guide the tape across the wide expanse of the travelling web of paper. My U.S. Pat. Nos. 4,783,018 and 5,046,675 disclose improvements in track guides, but now there are further improvements to such tracks that are available to the public.

It is an object of this invention to provide an improved track assembly for guiding a cutting tape across a web of paper to be cut. It is another object of this invention to provide a track with longer life and more versatility in both guiding the tape and in releasing it for its cutting operation. Still other objects will be apparent from the more detailed description which follows.

BRIEF SUMMARY OF THE INVENTION

This invention relates to an assembly for guiding a cutting tape transversely across a moving web of paper being wound up on a roll, the assembly including a track, a track carrier, and a carrier support. The track is an elongated member having an H-shaped transverse cross-section symmetrical about its longitudinal central axis, and having an upper and a lower longitudinal deep, broad groove, rectangular in transverse cross section. Adjacent to the bottom of each rectangular deep groove is a pair of shallow thin aligned grooves parallel to the central axis. The track carrier is a semi-cylindrical member having a longitudinal central axis and a longitudinal trough adapted to seat the elongated track thereon. The carrier support is an elongated hollow self-supporting structure having two parallel side walls joined to a concave top adapted to form a seat for the track carrier, and having spaced ledges along its walls on the inside surfaces facing each other and adapted to form shelves to fit over and contain an elongated load-supporting splicing beam, and intermittent stiffening bridges. The semi-cylindrical track carrier is adapted to be rotatably adjustable about the longitudinal central axis of the track and to be securely fastened to the concave top in any selected position.

In specific and preferred embodiments of the invention the track is an extruded polyolefin article that can be turned upside down to use a second tape guide when the first one is worn, and the track can be twisted about its longitudinal axis to provide selected positions for more conducive dynamics in the cutting tapes exit during the cutting operation. The assembly also provides protection against dust contamination in the track.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The invention is best understood by the following description taken in connection with the attached drawings and reference numbers thereon.

Figure 1:
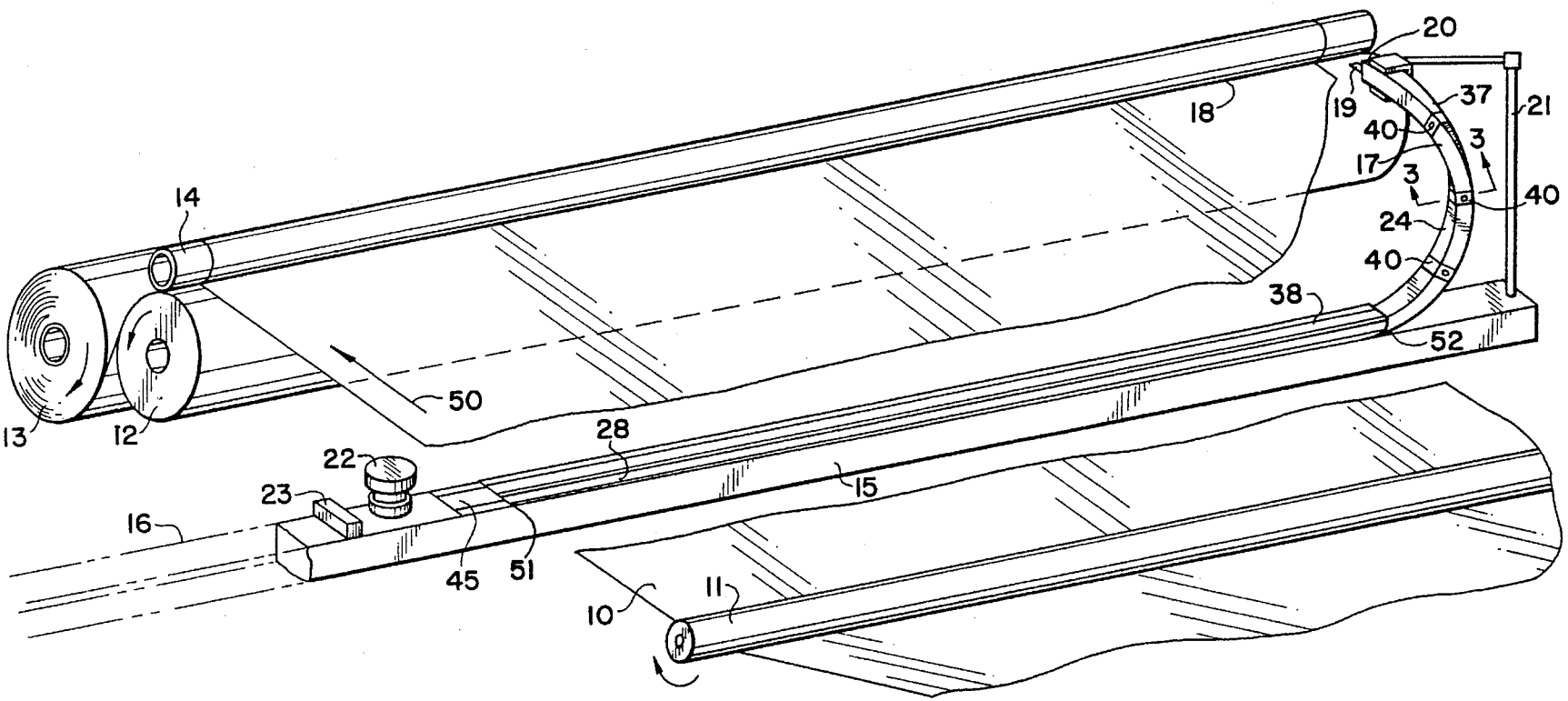
FIG. 1 is a schematic view in perspective of the track assembly of this invention as used to cut a travelling web of paper and transfer it to an empty wind up roll.

In FIG. 1 there is shown the way in which this invention is used in the paper industry to cut a moving web of paper being wound up on a roll, and transferring the cut edge of the paper to an empty wind up roll without having to stop the paper movement. The web of paper 10 is moving in the direction of the arrow 50 under a lead-in roller 11, and over drive roller 12 to wind up roll 13. Drive roll 12 is driven by an outside source, and it drives wind up roll 13 by frictional contact. When wind up roll 13 becomes large enough (i.e., contains enough wound up paper 10), it is necessary to cut the paper web 10 and start it winding on a new roll. In this case, new, empty wind up roll 14 is lowered vertically until it contacts drive roll 12. All rolls 11, 12, 13 and 14 turn in the direction of the indicated unnumbered arrows. In order to cut the moving paper web 10 and start it winding onto roll 14, a cutting tape 19, at terminal end 20 of tape track 24 is moved forward and is caught in the nip 18 of rolls 12 and 14. Tape 19 is wrapped helically around roll 14 as roll 14 turns, and in so doing tape 19 cuts through paper web 10 and leads the cut edge onto roll 14 which continues to wind up web 10 until it is full and the entire operation is repeated to cut and transfer the web to a new, empty wind up roll. Soon after web 10 is transferred to roll 14, full roll 13 is moved away from drive roll 12, and roll 14 is moved down to the previous position of roll 13.

Tape 19 is introduced into a track in the dispensing section 16 where it is treated to apply a coating of pressure-sensitive adhesive to the forward section of the tape, the tape is cut to a finite length and pushed along until the tip 19 is at terminal end 20, and the tape is then stopped and held in position until an operator decides it is time to cut and transfer the web to a new roll 14. Dispensing section 16 is not a part of the present invention, and is described and claimed in my copending patent application Docket No. D-6406) and filed concurrently herewith. The adhesive dispenser which is preferred for coating the tape is described and claimed in my copending patent application, (Docket No. D-6407), filed concurrently herewith. The track assembly of this invention is shown at 15 on the drawings. It abuts the end of the track in dispensing section 16, and continues across the web 10 from proximal end 51 to distal end 52. The track 24 continues from distal end 52 through an upward curving and twisting section 17 to a terminal end at 20. The adhesive coating applied in dispensing section 16 is on the bottom of tape 19 as it crosses through track assembly 15, and must be twisted to be on top when it is fed to roll 14 so as to stick to roll 14 and carry along with it the cut edge of paper web 10. The present invention relates to the track and carrier from proximal end 51 to distal end 52 and the extended track and its appurtenances from distal end 52 to terminal 20.

FIG. 1 includes brake 22 which is a clamping device to apply a variable resistance to tape 19 in preventing or inhibiting its movement through track assembly 15. Movement is stopped when the tape is first moved into position with its forward tip 19 at terminal end 20. When the time for cutting the web of paper 10 occurs, tip 19 is fed into nip 18 and the tape is suddenly accelerated to a high speed by its contact with roll 14 which causes the tape to be jerked out of track assembly. At this time the brake is applied to provide resistance but not to prevent movement of the tape. As soon as the tip 19 starts to wind around roll 14 the brake resistance causes the tape to become taut and cut web 10 as it is moved across web 10 because of being wound helically on roll 14. The tape will be pulled rapidly and upwardly out of track 24, and brake 22 must be applied properly for this to happen with control and without breakage of the tape.

Sensor 23 is employed merely to be sure there is no tape in track 24 after the cutting operation is finished. If the tape breaks, there may be some pieces of tape in track 24 that will impede the next setup of placing a tape, with adhesive on the forward end ready for the next cutting and transferring operation. Brake 22 and sensor 23 are more properly components of dispensing section 16, and are mentioned here merely as context.

Figure 2:
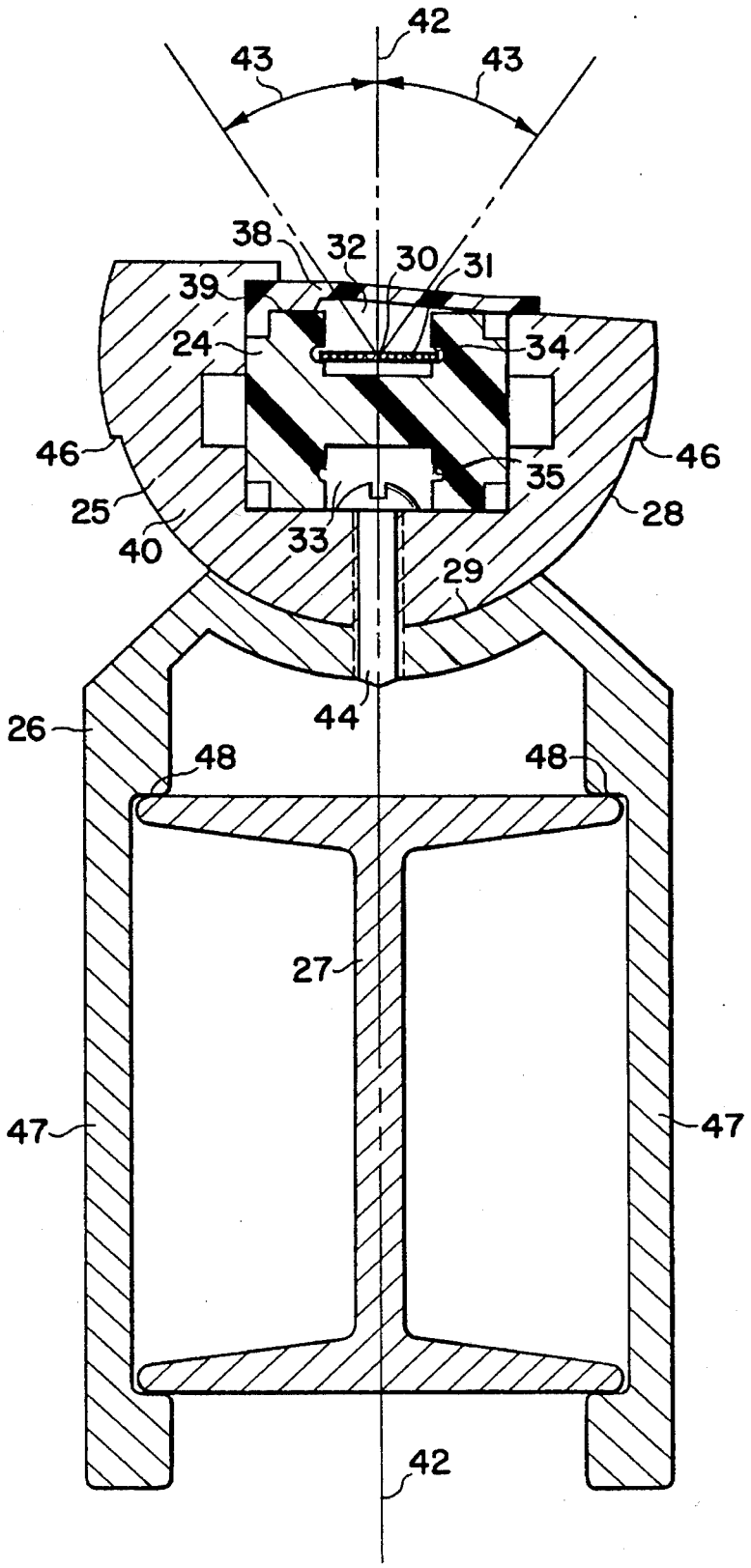
FIG. 2 is a transverse cross-sectional view of the track assembly of this invention.
Figure 3:
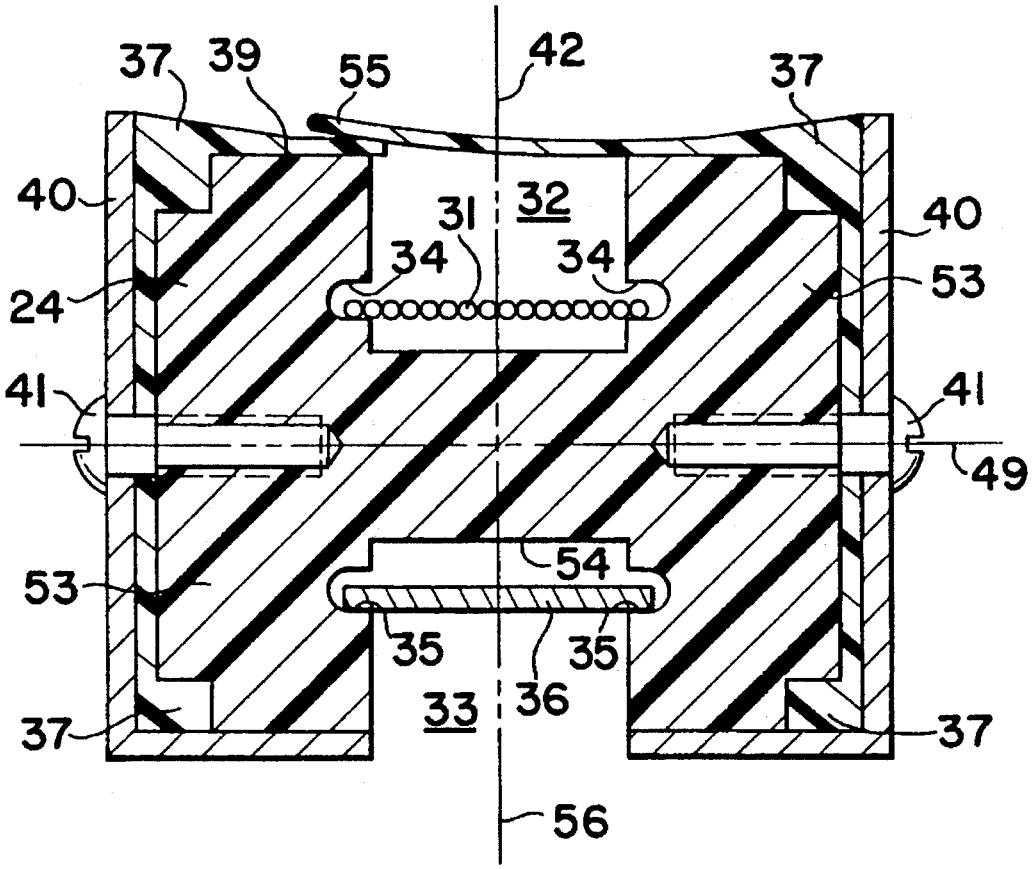
FIG. 3 is a cross-sectional view taken at 3—3 of FIG. 1.

FIGS. 2–3 show the details of the track assembly 15. FIG. 3 shows the extended track in the curved and twisted section 17 leading to terminal 20. The assembly 15 includes track 24, track carrier 25, and track carrier support 26. Track 24 is generally an H-shaped article, preferably an extrusion of a polyolefin, e.g., high molecular weight polyethylene. Such a material is strong, stiff, and has a low surface friction which will permit the tape to slide easily on a surface of this material. The H-shape comprises two parallel vertical legs 53 joined to a cross bar 54. This shape provides two deep U-shaped channels or grooves on opposite sides of track 24; upper deep groove 32 and lower deep groove 33. In each of deep grooves 32 and 33 there is a pair of shallow grooves 34 and 35, respectively, adjacent the bottom of deep grooves 32 and 33. Shallow grooves 34 and 35 are intended to function as ledges to support cutting tape 31 at its lateral edges, with the center of the tape spanning the deep groove between such edges so as not to touch the strip of pressure-sensitive adhesive placed there in dispensing section 16. Track 24 is symmetrical about both of its horizontal and vertical axes. In actual use with track 24 positioned such that its top face is 39 and its upper deep groove 32 is vertically above lower deep groove 33, shallow grooves 34 will serve to carry and guide cutting tape 31. When it becomes necessary to replace shallow grooves 34 because of wear and tear, track 24 can be turned upside down so as to use shallow grooves 35 to support and guide cutting tape 31. In normal operation, however, lower shallow grooves 35 empty or are filled with a strip 36 of steel or other stiff material to provide an additional stiffness to track 24 and some protection against contamination.

Track carrier 25 is an elongated semi-cylindrical structure which carries track 24 in its operational position. Generally carrier 25 will be aluminum, although other materials are suitable. Carrier 25 has a central axial lengthwise rectangular groove in which track 24 is seated. Preferably this groove is fitted with a cover 38 of a rubbery or resilient material to protect upper deep groove 32, cutting tape 31, and other faces of track 24 from dust and other contaminants that might prevent efficient handling of tape 31 or hamper its cutting action.

The carrier 25 is primarily intended to enclose and protect the track 24 along the length of track 24 that is directly beneath paper web 10. As seen in FIG. 1, the cutting tape 31 must be conveyed to track terminus 20 near the nip point 18 between rolls 12 and 14. Practical considerations will generally prevent the use of track carrier 25 from distal end 52 to track terminus 20 through the twist and arch necessary to face the adhesive coating on cutting tape 31 toward roll 14 at nip point 18. As it is still desirable to protect track 24, cutting tape 31, and all interior track surfaces through the curve from distal end 52 of track carrier 25 to track end 20, a rubber sheath 37 is attached to track 24 by uniformly spaced clips 40 and screws 41 on both sides of track 24. Rubber sheath 37 may be installed as one piece and then split to provide an exit for the cutting tape 31 or sheath 37 may be installed as two overlapping pieces. The major consideration in the design of rubber sheath 37 is that it will provide groove 32 and cutting tape 31 with protection from falling or airborne debris. The design of sheath 37 may vary with respect to its profile opening attachment to track 24. Additionally, track 24 may be stiffened to better support itself between distal end 52 and end support 21 by use of a stiff metal strip 36 inserted into the shallow grooves 35 in deep groove 33 on the side of profile 24 opposite that which carries cutting tape 31. Metal strip 36 also protects shallow grooves 35 and deep groove 33 from damage, preserving them for subsequent use when the track 24 is reversed.

Track carrier 26 is a structure designed to support carrier 25 in the desired position underneath paper web 10. Legs or side walls 47 together with ledges 48 provide for stiffness of the support so it may be mounted from its ends at either side of the web. The horizontal axis 30 of track carrier 26 passes through the center of tape 31 resting in shallow grooves 34. The curved outer surface 28 of track carrier 25 resting in the concave upper surface 29 of support 26 permits track carrier 25 to be rotated about axis 30 so as to tilt upper face 39 of track 24 in either direction as shown by arrows 43. Generally the maximum amount of tilt 43 is about 35° on either side of vertical centerline 42. This tilting provides for positioning track 24, and thereby cutting tape 31, in positions more conducive to efficient cutting of web 10 in confined installations of the turn-up equipment. Stops 46 on the perimeter of surface 28 prevent tilting to any greater degree than that chosen for angles 43. Spaced set screws 44 along the length of track assembly; 15 will fix the tilt at whatever angle is chosen. Track carrier 25 is secured to track carrier support 26, by regularly spaced screws 44 to cause the two profiles to reinforce each other and to fix track carrier 25 at any desired angle.

Legs 47 and ledges 48 are so designed to accept I-beam 42 with a sliding fit. A short section of I-beam 42 is then attached to the paper machine producing web 10 or other convenient structure at either side of the web 10 by any of a number of support means, in order to provide a means by which to support both ends of track carrier support 26, which is slipped over I-beam 42 at each end. The slip-fit of I-beam 42 in track carrier support 26 also provides for mounting equipment to the proximal end 51 of the track assembly 15 as would be required to dispense and controls the cutting tape 31. The most significant advantage of designing the slip-fit of I-beam 42 in track carrier support 26 is that it allows the adjustment of the turn-up system to suit varying widths of web 10 in the same machine. If track support 21 is fastened to track carrier support 26, and that track carrier support 26 may slide over its end supports made of I-beam 42, it can be seen that the position of track end 20 may be adjusted by an operator located near proximal end 51 by moving the entire track assembly 15 on its end mounting points.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A track assembly for guiding a cutting tape transversely across a moving web of paper being wound up on a roll, said assembly including a track, a track carrier, and a carrier support; said track being an elongated member having an H-shaped transverse cross-section symmetrical about its longidutinal centerline, and having an upper and a lower longitudinal U-shaped slot, each said channel being defined by a pair of spaced walls and a bottom and being generally rectangular in transverse cross section, said pair of spaced walls having formed therein aligned grooves parallel to said centerline for receiving a cutting tape therebetween; said track carrier being a semi-cylindrical member having a longitudinal centerline and a longitudinal trough adapted to seat said elongated member thereon; said carrier support being an elongated hollow structure having two parallel side walls joined to a concave top adapted to form a seat for said track carrier, said carrier support having spaced ledges along said side walls on inside surfaces thereof facing each other and adapted to form shelves to fit around and contain an elongated, load-supporting, connecting beam; said semi-cylindrical track carrier being adapted to be securely fastened to said concave top in any selected position rotatably spaced about said longitudinal centerline of said track.

2. The assembly of claim 1 wherein said track is formed of a low friction material.

3. The assembly of claim 2 wherein said track is an article of extruded polyolefin.

4. The assembly of claim 1 wherein said track is positioned horizontally with each pair of grooves being sized to receive said cutting tape slidably therein.

5. The assembly of claim 4 wherein said lower pair of grooves contains an elongated strip of a stiffening material therein.

6. The assembly of claim 1 wherein said track is seated in an elongated rectangular groove in said track carrier with one of said channel facing upward and another of said deep channel facing downward, said upper channel being covered by a flexible flap adapted to be upwardly bendable to uncover said upper channel.

7. The assembly of claim 6 wherein said track is releasably fastened to said track carrier.

8. The assembly of claim 1 wherein said track carrier can be rotated about its longitudinal centerline through about 35° on either side of its central position when the legs of said H-shape are vertical.

9. The assembly of claim 1 having a proximal end near an operator and a distal end across the width of said web of paper, and being positioned underneath, and transversely to, said web of paper travelling toward a roll upon which the paper is being wound up.

10. The assembly of claim 9 wherein a tape brake device is located at said proximal end, and a short section of said track immediately subsequent to said brake is made of hard-surfaced aluminum.

11. The assembly of claim 9 wherein said track continues from said distal end in an upwardly curving and twisting direction to a terminal end adjacent an empty wind up roll to which said paper web is expected to be transferred, with said upper channel at said distal end being positioned as said lower channel at said terminal end.

12. A track assembly for guiding a cutting tape transversely across and underneath a travelling web of paper being wound onto a roll, said assembly including a track, a track carrier, and a track carrier support; said track being an elongated extruded polyolefin structure having a constant transverse cross-section including horizontally spaced ledges to support the outer edges of a horizontally positioned tape with no support for the central portion of said tape between said ledges; said track carrier support being an elongated semi-cylindrical structure having a longitudinal centerline and a constant transverse cross-section including a central rectangular groove to seat said track with a horizontal top face generally parallel to said tape, said track being secured in a fixed position in said groove; said track carrier support being an elongated structure adapted to support said track carrier on a horizontal base over a selected length of said assembly, said support having a concave upper horizontal surface adapted to form a seat for said track carrier and to fasten said track carrier to said support in any selected position wherein said track carrier is rotated about its centerline to an extent of about 35° in either direction from a center position where said track top face is horizontal.

13. The assembly of claim 12 which additionally includes an I-beam structure attached to said track carrier support at selected positions to maintain alignment of abutting connections of said track.

14. The assembly of claim 12 having a distal end spaced away from an operator of said assembly and a proximal end adjacent said operator, said track extending outwardly of said distal end and curved to terminate adjacent a wind up roll for said paper web, said track including at said proximal end a brake mechanism adapted to clamp said tape to produce selected resistance against movement of said tape through said track, and immediately adjacent to and subsequent to said brake mechanism, a short length of said assembly wherein said track is modified to make it more wear-resistant than said extruded polyolefin.

15. The assembly of claim 14 wherein said short length of track is made of a hard-surfaced aluminum coated with a polyfluorocarbon low friction material.

16. The assembly of claim 14 wherein said track extending outwardly of said distal end is substantially enclosed in a sheath of resilient material with a lengthwise split in said sheath adjacent said cutting tape and extending from said distal end to its termination adjacent a wind up roll.

17. The assembly of claim 14 wherein said proximal end is abutted to an end of a dispensing section of track adapted to slidably conduct said cutting tape from an initial supply through treating and cutting operations in which said tape is coated with a pressure-sensitive adhesive at its forward end, and is cut to a selected length at its rearward end.

18. The assembly of claim 12 wherein said track includes a longitudinal rectangular groove extending from said top face to said spaced ledges, said groove being slightly narrower than the horizontal space between said ledges, and a flexible rubber flap covering said groove along said top face.

19. A track assembly for guiding a cutting tape transversely across a moving web of paper being wound up on a roll, said assembly including a track, a track carrier, and a carrier support, said track including an elongated member having a cutting tape guideway extending along its longitudinal centerline throughout its length, said member having an elongated space beneath said guideway whereby adhesive applied to an underside surface of a cutting tape may unimpededly traverse said guideway, said track carrier including a semi-cylindrical member having a longitudinal centerline and a longitudinal trough for receiving and seating said elongated member therein, said carrier support including an elongated cylindrical upper surface for forming a seat for said semi-cylindrical member, means for fastening said semi-cylindrical member to said carrier support with said semi-cylindrical member being supported on said cylindrical upper surface in any selected position rotated about said longitudinal centerline of said track.

20. The assembly as defined in claim 19 further comprising a flexible flap overlying said guideway.

21. The assembly as defined in claim 19 wherein said track includes an auxiliary cutting tape guideway extending parallel and beneath said guideway, an elongated strip of substantially the same cross-sectional dimension as that of said cutting tape being disposed in selected portions of said auxiliary guideway.

22. The assembly as defined in claim 21 wherein said means for fastening includes spaced screw means located along said auxiliary guideway for affixing said track carrier to said semi-cylindrical member.

23. The assembly of claim 19 further comprising a support beam extending along and engaged with said carrier support for positioning said carrier support beneath a moving web of paper and adjacent and along an elongated drive roll driving an elongated take-up roll upon which a moving web of paper is to be wound.

* * * * *